US006253960B1

(12) United States Patent
Bilskie et al.

(10) Patent No.: US 6,253,960 B1
(45) **Date of Patent: *Jul. 3, 2001**

(54) SELF-CONTAINED HIGH PRESSURE PNEUMATIC BEVERAGE DISPENSING SYSTEM

(75) Inventors: Richard P. Bilskie; Edward N. Oyler, both of Newnan; Harold F. Stover, Grantville, all of GA (US)

(73) Assignee: S.O.B. Partnership, Newnan, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/430,148

(22) Filed: Oct. 29, 1999

(51) Int. Cl.[7] ..... B67D 5/08
(52) U.S. Cl. ..... 222/67; 222/129.2; 222/136
(58) Field of Search ..... 222/399, 146.6, 222/136, 386.5, 129.1, 129.2, 51, 67

(56) References Cited

U.S. PATENT DOCUMENTS

| | | | | |
|---|---|---|---|---|
| 3,731,845 | * | 5/1973 | Booth | 222/67 |
| 4,560,089 | * | 12/1985 | McMillin et al. | 222/399 |
| 5,190,189 | * | 3/1993 | Zimmer et al. | 222/67 |
| 5,191,999 | * | 3/1993 | Cleland | 222/67 |
| 6,021,922 | * | 2/2000 | Bilskie et al. | 222/136 |

FOREIGN PATENT DOCUMENTS

| | | |
|---|---|---|
| 0238274 | 9/1987 | (EP) . |
| 1191510 | 5/1970 | (GB) . |
| 1274455 | 5/1972 | (GB) . |

* cited by examiner

*Primary Examiner*—Philippe Derakshani
(74) *Attorney, Agent, or Firm*—Thomas, Kayden, Horstemeyer &Risley, LLP

(57) ABSTRACT

The present disclosure relates to a self-contained high pressure pneumatic beverage dispensing system. In each embodiment of the dispensing system, the dispensing system comprises a carbonator tank dispensing system which includes a water valve that is adapted to connect in fluid communication to a carbonator tank and to a source of pressurized water. The water valve has an open position in which water from the source of pressurized water can flow through the water valve and into the carbonator tank and further has a closed position in which water from the source of pressurized water cannot flow through the water valve into the carbonator tank. The dispensing system further includes at least one proximity switch that is adapted to operably connect in fluid communication to the water valve and a source of pressurized gas. The proximity switch has an open position in which gas from the source of pressurized gas can flow through the proximity switch and a closed position in which gas from the source of gas cannot flow through the proximity switch. In use, the proximity switch is configured so as to detect a fill condition of the carbonator tank so that the proximity switch can send a pneumatic signal to the water valve to cause the water valve to open or shut depending upon the detected fill condition.

44 Claims, 11 Drawing Sheets

SELF-CONTAINED HIGH PRESSURE PNEUMATIC BEVERAGE DISPENSING SYSTEM

CLAIM OF PRIORITY AND CROSS-REFERENCE TO RELATED APPLICATION

The present application claims the benefit of the filing date of U.S. patent application Ser. No. 08/965,711, filed Nov. 7, 1997 now U.S. Pat. No. 6,021,926, U.S. patent application Ser. No. 09/353,862, filed Jul. 15, 1999, and U.S. patent application Ser. No. 09/419,865 filed Oct. 19, 1999, each of which is incorporated herein by reference in their entireties.

FIELD OF THE INVENTION

The present disclosure relates generally to beverage dispensing systems configured for portable or fixed installations. More particularly, the present disclosure relates to a self-contained, high pressure pneumatic beverage dispensing system that is especially adapted for use on airplanes, railcars, ships, and the like, as well as for installation in golf carts and other such small vehicles.

BACKGROUND OF THE INVENTION

Conventionally, beverage dispensing systems have required electrical or gasoline power. Therefore, these systems tend to be bulky and usually are unsuitable for portable applications.

Typically, conventional beverage dispensing systems comprise a high pressure carbonator tank plumbed to a carbon dioxide ($CO_2$) cylinder through a pressure regulator in which the pressure to be supplied to the carbonator tank is reduced to approximately 90 pounds per square inch (psi). A motorized pump plumbed to a fixed water tap system is used to pressurize the water supplied to the tank to approximately 200 psi. The high pressure water flows into the carbonator tank, overcoming the rising pressure of the $CO_2$ gas contained therein. As the carbonator tank fills with this high pressure water, a pocket of $CO_2$ gas that exists above the water is compressed, forcing the $CO_2$ gas to be absorbed into the water, thereby creating carbonated water. In that these conventional beverage dispensing systems require a constant source of power to operate the pump motor, use of such systems is generally limited to fixed installations.

Although portable beverage dispensing systems that do not require electrical or gasoline powered pumps have been developed, these systems have several disadvantages. One such system is that disclosed in U.S. Pat. No. 5,411,179 (Oyler et al.) and U.S. Pat. No. 5,553,749 (Oyler et al.). Similar to the systems described in the present disclosure, the system described in these patents uses high pressure $CO_2$ gas supplied by a $CO_2$ tank to pressurize the water that is supplied to a carbonator tank. Unlike the present systems described in the instant disclosure, however, the system described in these patent references uses a low pressure carbonator tank which typically operates at pressures below 100 psi.

Despite providing for some degree of water carbonation (typically, approximately 2.5%), such low pressure systems do not produce beverages having a commercially acceptable level of carbonation (generally between 3% to 4%). Experimentation has shown that the pressurized water must be cooled to a low temperature prior to entering the carbonator tank of these systems to achieve absorption of $CO_2$ gas into the water. This cooling typically is effected by using a cold plate through which the pressurized water passes just prior to being supplied to the carbonator tank.

As mentioned above, low, albeit marginally acceptable, levels of carbonation can be attained with these low pressure systems. One significant drawback of using this method, however, is that the $CO_2$ gas contained within the carbonated water can be quickly diffused from the water when it is heated to a warmer temperature. Accordingly, when the carbonated water is post-mixed with relatively warm liquids such as concentrated syrups, juices, and the like, the relatively small amount of carbonation contained within the water can be quickly lost.

From the foregoing, it can be appreciated that it would be desirable to have a self-contained beverage dispensing system that is completely portable and that produces beverages having a commercially acceptable level of stable carbonation.

SUMMARY OF THE INVENTION

The present disclosure relates to a self-contained high pressure pneumatic beverage dispensing system. In each embodiment, the dispensing system comprises a carbonator tank filling system which includes a water valve that is adapted to connect in fluid communication to a carbonator tank and to a source of pressurized water. The water valve has an open position in which water from the source of pressurized water can flow through the water valve and into the carbonator tank and further has a closed position in which water from the source of pressurized water cannot flow through the water valve into the carbonator tank. The filling system further includes at least one proximity switch that is adapted to operably connect in fluid communication to the water valve and a source of pressurized gas. The at least one proximity switch has an open position in which gas from the source of pressurized gas can flow through the at least one proximity switch and a closed position in which gas from the source of gas cannot flow through the at least one proximity switch.

In use, the at least one proximity switch is configured so as to detect a fill condition of the carbonator tank so that the at least one proximity switch can send a pneumatic signal to the water valve to cause the water valve to open or shut depending upon the detected fill condition.

The features and advantages of the invention will become apparent upon reading the following specification, when taken in conjunction with the accompanying drawings.

DETAILED DESCRIPTION

Referring now IN more detail to the drawings, in which like numerals indicate corresponding parts throughout the several views, FIGS. 1–11 illustrate various embodiments of a self-contained, high pressure pneumatic beverage dispensing system and various components thereof.

Figure 1:
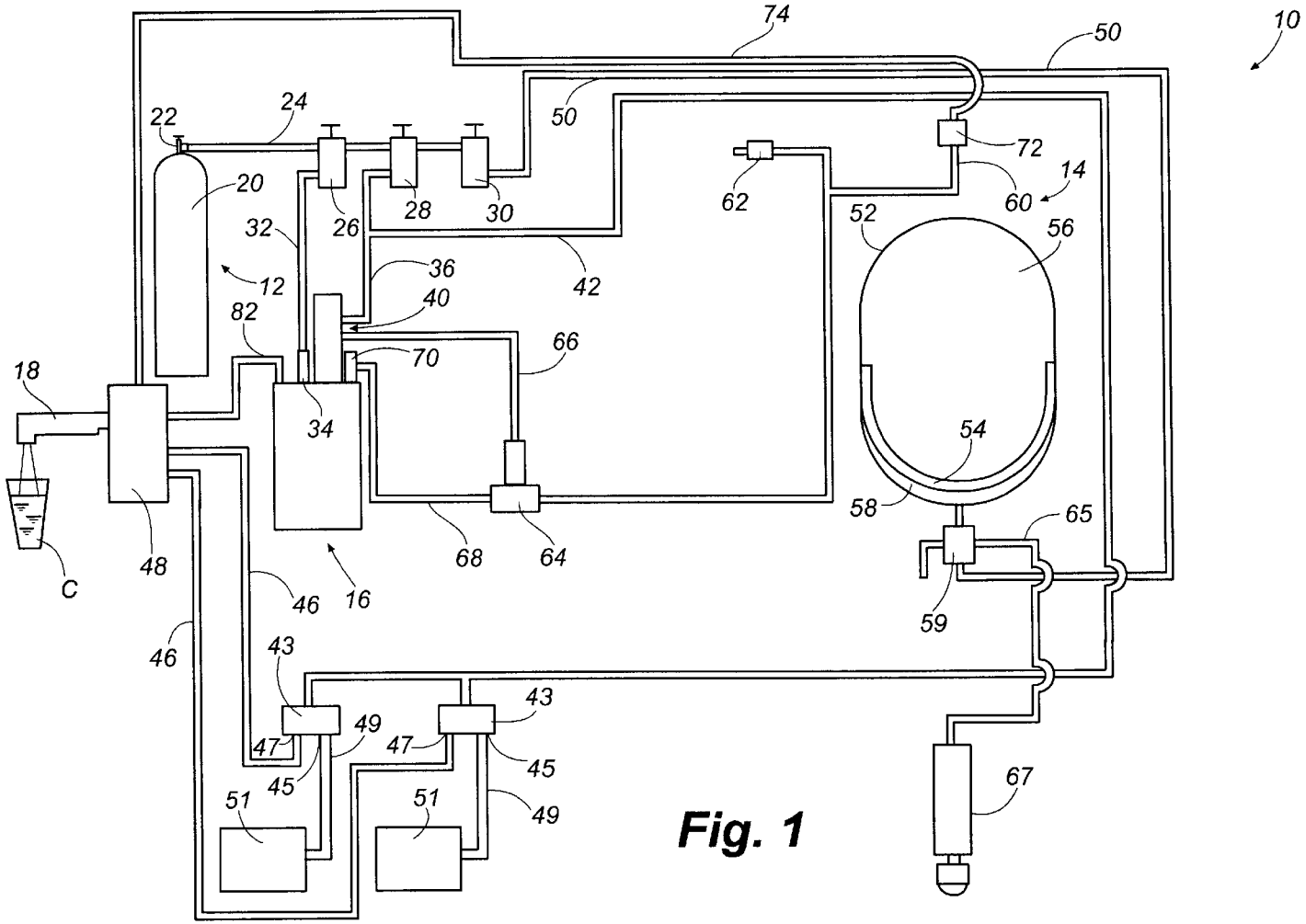
FIG. 1 is a schematic view of a first embodiment of a self-contained high pressure pneumatic beverage dispensing system.

FIG. 1 is a schematic view of a first embodiment 10 of the self-contained high pressure pneumatic beverage dispensing system. The system generally comprises a source 12 of gas, typically, although not necessarily, carbon dioxide ($CO_2$) at high pressure, a source 14 of high pressure water, a high pressure carbonator tank 16, and a beverage dispensing valve 18. The source 14 of gas at high pressure typically comprises a conventional refillable gas storage tank that is filled with pressurized $CO_2$ gas. As will be discussed in more detail below, the pressurized $CO_{2\ gas}$ contained within the gas storage tank 20 is used to both carbonate water in the carbonator tank 16 as well as to pressurize and propel the water to be supplied to the carbonator tank 16.

The $CO_2$ gas exits the gas storage cylinder 20 through a gas shut-off valve 22. When the gas shut-off valve 22 is opened, $CO_2$ gas travels through a gas outlet line 24 and is supplied to three separate gas pressure regulators 26, 28, and 30. The gas traveling through the first pressure regulator 26 is reduced in pressure to approximately 90 pounds per square inch (psi) to 110 psi and then exits the pressure regulator 26 to enter a carbonator tank supply line 32. The carbonator tank supply line 32 directs the $CO_2$ gas to a gas inlet 34 of the high pressure carbonator tank 16 so that the carbonator tank 16 can be filled with pressurized $CO_2$ gas.

The $CO_2$ gas that travels through the second gas pressure regulator 28 is reduced in pressure to approximately 25 psi to 60 psi. After exiting the second gas pressure regulator 28, the $CO_2$ gas flows into a carbonator tank filling system supply line 36. The filling system supply line 36 is connected to a carbonator tank fling system 40, the configuration and operation of which is described in detail hereinafter.

Along the filling system supply line 36, between the second gas pressure regulator 28 and the filling system 40, is a pump line 42 that is in fluid communication with at least one pneumatic pump 43. By way of example, two such pumps 43 are shown in FIG. 1. Each pump 43 can comprise a vacuum pump of conventional design which comprises an interior diaphragm (not shown) which is operably connected to an inner reversible valve (not shown). Each pump 43 is configured such that, when supplied with pressurized gas, the diaphragm can reciprocate back and forth under the control of the reversible valve so as to draw liquid into the pump 43 through an inlet 45, and expel the drawn liquid out from the pump 43 through an outlet 47. As indicated in FIG. 1, the inlets 45 are connected to suction lines 49 that connect the pumps 43 to liquid reservoirs 51 which, for instance, comprise bag-in-box containers holding soft drink syrups and/or juice concentrates. Connected to the outlets 47 are supply lines 46 that connect the pumps 43 to a cold plate 48 in which the syrup or concentrate can be cooled to an appropriate serving temperature.

As is known in the art, when the pressure on both sides of the vacuum pump diaphragm equalizes, i.e. the pressure of the gas supplied by line 42 equals the pressure in line 46, the pump 43 will stall to interrupt reciprocation of the pump 43. When the pressure becomes unequal, e.g. when the pressure in line 46 drops as syrup or concentrate is distributed by the operator, the pump 43 will again reciprocate to draw and expel these liquids. Presently deemed suitable for use in the herein described embodiment are Model 5000 vacuum pumps available from Flowjet. From the cold plate 48, the syrup or concentrate then can be discharged through the beverage dispenser valve 18 as desired. Although in the foregoing, the invention has been described as comprising a vacuum pump and a bag-in-box container, it is to be appreciated that equivalent substitutes for either or both of these components could be used in the present embodiment as desired. Accordingly, the identification of vacuum pumps and bag-in-box containers is not intended to limit the scope of the present disclosure.

The $CO_2$ gas supplied to the third gas pressure regulator 30 is lowered in pressure to approximately 175 psi to 225 psi. After passing through the third gas pressure regulator 30, the $CO_2$ gas is ported through a high pressure gas supply line 50 that supplies gas pressure to the pressurized water source 14 of the system. In this first embodiment, the water source 14 comprises a high pressure water tank 52. Although capable of alternative configurations, this water tank 52 typically is constructed of a strong, corrosion resistant metal such as stainless steel. Inside the water tank 52 is a pliable diaphragm 54 that separates the interior of the water tank into two separate chambers 56 and 58. The upper, or water, chamber 56 of the water tank 52 is adapted to store water that will be supplied to the carbonator tank 16 for carbonization. The lower, or gas, chamber 58 is adapted to receive high pressure gas that is used to pressurize the water contained in the water chamber 56. The pliable diaphragm 54 completely isolates each chamber from the other such that no mixture of the water and $CO_2$ gas can occur.

Connected to the water chamber side of the water tank 52 is a water chamber line 60. Among other functions discussed hereinafter, the water chamber line 60 can be used to refill the water chamber 56 of the water tank 52. To refill the tank 52, a refill inlet check valve 62 connected to one branch of the water chamber line 60 is connected to a source of water having positive head pressure which, depending upon personal preferences, can be a source of purified water or a standard tap water source. It will be understood that refilling should only be attempted when the water tank is in a depressurized state.

Positioned along the high pressure gas supply line 50 between the third gas pressure regulator 30 and the water tank 52 is a water tank valve 59. The water tank valve 59 typically comprises a three-way vent valve which is manually operable to control the pressurization or depressurization of the gas chamber 58 of the water tank 52. When switched to an open position, the water tank valve 59 directs high pressure $CO_2$ gas into the gas chamber 58 of the water tank 52. This high pressure gas urges the pliable diaphragm 54 against the volume of water contained within the water chamber 56 to increase the pressure of the water to a level within the range of approximately 175 psi to 225 psi. When the operator wishes to refill the tank 52 with water in the manner described above, the valve 59 is manually switched to a closed position in which the supply of high pressure $CO_2$ gas to the water tank 52 is shut-off, and the high pressure gas contained in the gas chamber 58 of the tank 52 is vented to the atmosphere to relieve the pressure therein. Preferably, this gas is first directed to a vent line 65 which leads to a diffuser 67 which, as is known in the art, gradually diffuses the vented gas into the atmosphere to reduce noise. Once the pressure within the tank 52 is reduced, the operator can refill the tank 52 with any water source capable of supplying water at a positive head pressure.

In addition to providing for refilling of the water tank 52, the water chamber line 60 is further used to transport the pressurized water supplied by the water tank 52 in two separate directions. In a first direction, the water is taken to a carbonator tank water valve 64 that is positioned intermediate the water tank 52 and the carbonator tank 16 along the water flow path existing between these two tanks. Typically, the water valve 64 is pneumatically actuated to open or close to permit or prevent the flow of water therethrough. In a preferred arrangement, the water valve 64 comprises a normally closed, high pressure bellows valve. Considered suitable for this use are HB Series bellows valves manufactured and commercially available from Nupro. As will be discussed hereinafter, the water valve 64 comprises part of the carbonator tank filling system 40. When supplied with a pneumatic pressure signal, the water valve 64 opens permitting high pressure water supplied by the water tank 52 to pass through the valve 64 and into a carbonator tank water supply line 68. In use, the water is transported through this supply line 68 to a water inlet 70 that is mounted to the carbonator tank 16 such that the tank 16 can be filled with the high pressure water. When needed, the carbonated water within the carbonator tank 16 can be transported to the cold plate 48 through a carbonated water supply line 82.

In addition to transporting high pressure water in the first direction to the water valve 64, the water chamber line 60 transports the water exiting the water tank 52 in a second direction to a water pressure regulator 72. This pressure regulator 72 reduces the pressure of the water supplied by the water tank 52 to approximately 40 psi. From the water pressure regulator 72, the water flows through a flat water supply line 74 and then through the cold plate 48 to be dispensed by the beverage dispenser 18 when activated by the operator.

Figure 2:
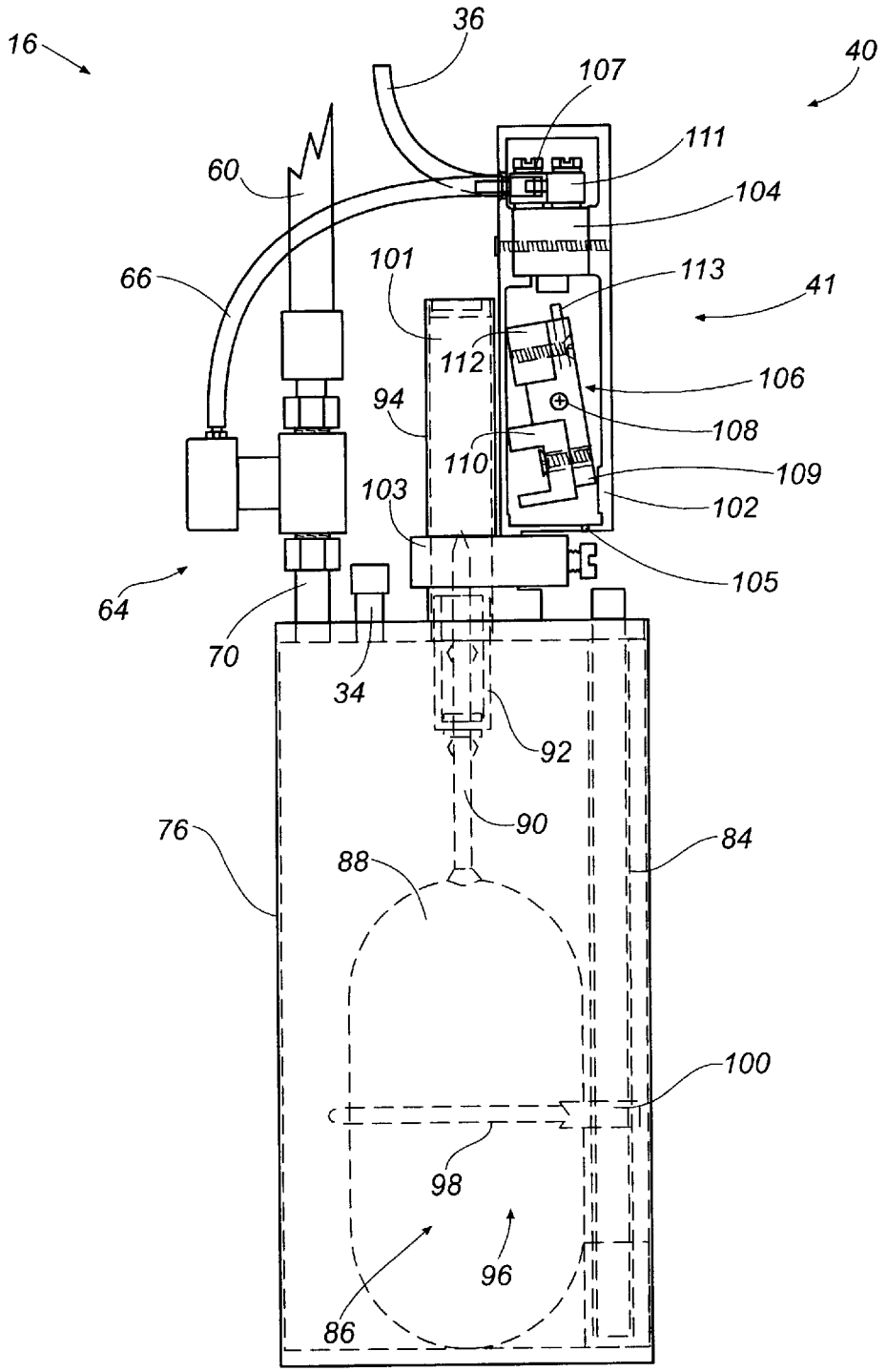
FIG. 2 is a side view of a first embodiment of a high pressure carbonator tank and filling system usable in the beverage dispensing system of FIG. 1, depicting an activated or fill orientation of the filling system.
Figure 3:
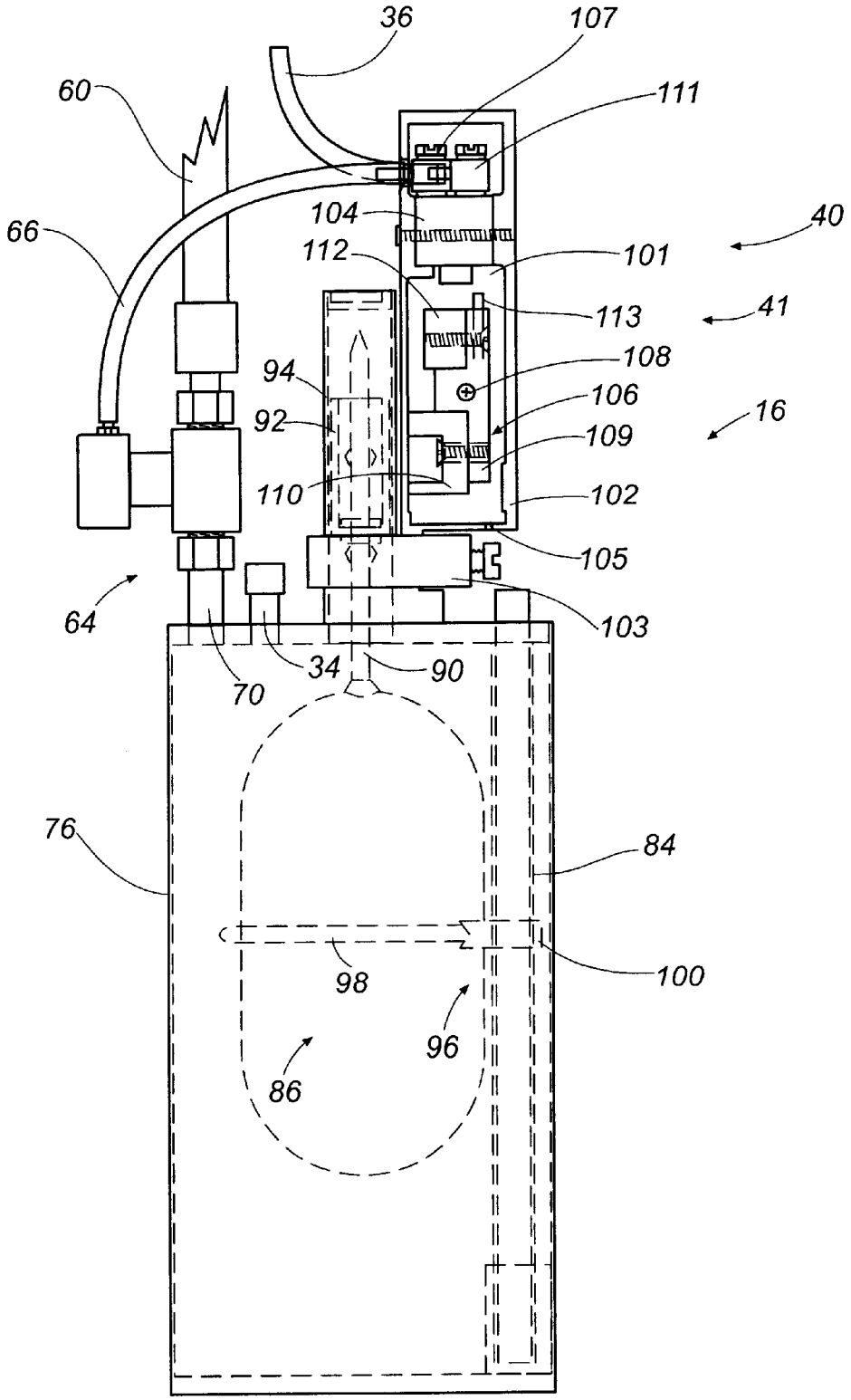
FIG. 3 is a side view of the carbonator tank and filing system of FIG. 2, depicting an inactivated or full orientation of the filling system.

The primary components of the first embodiment 10 of the dispensing system having been described, the configuration and operation of a first embodiment of a high pressure carbonator tank 16 and filing system 40 used therewith will now be discussed. As illustrated in FIGS. 2 and 3, the carbonator tank 16 typically comprises a substantially cylindrical tank 76 which normally is constructed of a strong metal such as steel. Presently considered to be suitable for use as a carbonator tank 16 is the Model-6 carbonator tank available from Jo'Bell. Mounted to the top of the tank 76 is the gas inlet 34 and the water inlet 70 identified in the foregoing. Normally, each of these inlets 34, 70 comprises an inner check valve (not shown) of conventional construction which prevents the reverse flow of water and gas therethrough. Inside the tank 76 is a carbonated water supply tube 84 that extends from the bottom of the tank 76 and up through the top of the tank 76 such that, when the beverage dispenser valve 18 is activated, carbonated water from the bottom of the tank 76 is forced through the supply tube 84 into the carbonated water supply line 82 (FIG. 1), through the cold plate 48, and finally out of the dispenser valve 18 into a suitable beverage container C.

In addition to the foregoing components, the carbonator tank 16 can further comprise a water level indicator mechanism 86 located within the tank 76. This mechanism 86 includes a hollow float member 88 having a rod 90 extending upwardly from the top portion of the float member 88. Positioned adjacent the top of the rod 90 is a magnetic member 92, by way of example, in the form of a magnetic cylinder. When the tank 76 is empty, the float member 88 rests on the bottom of the tank 76, as shown in FIG. 2. When situated in this empty configuration, part of the magnetic member 92 is positioned within the tank 76 while part is positioned within an elongated hollow tube 94 that extends upwardly from the top of the tank 76. This hollow tube 94 permits travel of the rod 90 and the magnetic member 92 in an upward direction, the purpose for which is explained hereinafter.

As the tank 76 is filled with water, the buoyancy of the float member 88 causes it to float towards the top of the tank 76. To maintain the float member 88, rod 90, and magnetic member 92 in the correct orientation, a mechanical stabilizer 96 can be provided. As illustrated in FIGS. 2 and 3, the stabilizer 96 can comprise a retainer band 98 that is wrapped about the float member 88 and a slide member 100 which is disposed about the carbonated water supply line 84 and to which the retainer band 98 is fixedly attached. Configured in this manner, the float member 88 will continue to rise within the tank 76 as the water level within the tank 76 increases. Similarly, the magnetic member 92 will rise within the elongated hollow tube 94 so that filling system 40 can detect when the tank 76 is full so that water flow into the tank 76 can be interrupted.

As depicted in FIGS. 2 and 3, the water level within the tank 76 is monitored and controlled by the carbonator tank filing system 40. In the first embodiment, the system 40 includes a water level switch 41 that comprises an outer housing 102 that is adapted to be mounted adjacent the hollow cylinder 94 of the carbonator tank 16 with a mounting bracket 103. Normally, the outer housing 102 is entirely closed to the atmosphere except for the provision of a vent opening 105 located, by way of example, at the base of the housing 102. As is discussed hereinafter, this vent opening 105 permits the passage of gas and/or condensation from the water level switch 41 when gas is vented from the filling system 40. Although capable of alternative construction, the outer housing 102 normally is constructed of an inexpensive, durable material such as aluminum or plastic. Located within an interior space 101 of the housing 102 is a proximity switch 104 and a lever arm 106. Although capable of alternative configurations, the proximity switch 104 typically comprises a normally closed, three-way magnetic proximity switch. As indicated in FIGS. 2 and 3, the proximity switch 104 includes a gas inlet 107 and a gas outlet 111. The gas inlet 107 is connected to the filling system supply line 36 while the gas outlet 111 is connected to a water valve signal line 66. Arranged in this manner, the proximity switch 104 is in fluid communication with both the source 12 of pressurized $CO_2$ gas as well as the water valve 64.

While the proximity switch 104 is fixed in position within the housing 102, the lever arm 106 is free to rotate about a pivot point 108 such that the lever arm 106 is pivotally mounted within the water level switch 40. Typically, the pivot point 108 includes a screw, pin, or other generally cylindrical member which can act as an axis of rotation for the lever arm 106. The lever arm 106 normally comprises a lever arm body 109 to which is mounted a magnet 110 and a counter weight 112. As shown in FIGS. 2 and 3, the counter weight 112 can be mounted to the lever arm body 109 above the pivot point 108 while the magnet 110 can be mounted to the lever arm body 109 below the pivot point 108. Regardless, the magnet 110 is mounted to the lever arm body 109 at a position in which it is adjacent to the magnetic member 92 when the level of water within the tank 76 is high (see FIG. 3). Further mounted to the lever arm body 109 is a magnetic member 113 whose proximity can be detected by the proximity switch 104. By way of example, this magnetic member 113 can comprise a steel set screw that is threaded into the top of the lever arm body 109.

When the carbonator tank 16 is not full, the carbonator tank filling system 40 is oriented in an activated, or fill, position illustrated in FIG. 2. As shown in this figure, the lever arm 106 is in a tilted orientation within the housing 102 during tank filling due in part to the force exerted upon the lever arm 106 by the counter weight 112. While the lever arm 106 is in this orientation, the magnetic member 113 is positioned closely adjacent to the proximity switch 104 so as to trigger the normally closed switch 104 to remain open and send a pneumatic signal to the water valve 64. As illustrated in FIGS. 2 and 3, this pneumatic signal can be sent to the water valve 64 via the water valve signal line 66 that extends from the gas outlet 111 of the proximity switch 104 to the water valve 64. This pneumatic signal sent along the signal line 66 similarly causes the normally closed water valve 64 to remain open to permit passage of pressurized water into the tank 76.

As the water level rises within the tank 76, the magnetic member 92 within the hollow tube 94 rises and eventually reaches a position at which it is positioned adjacent the magnet 110 mounted on the lever arm body 109. Since the magnetic member 92 is constructed of a magnetic material, such as magnetic stainless steel, the magnet 110 of the lever arm 106 is attracted to the member 92. In that the attractive forces between the magnet 110 and the magnetic member 92 are greater than the force imposed upon the lever arm 106 by the counter weight 112, the lever arm 106 pivots backwardly to assume a generally vertical orientation depicted in FIG. 3. Due to this pivoting, the proximity switch 104 loses the signal created by the proximity of the magnetic member 113, thereby deactivating the proximity switch 104. Being deactivated, the proximity switch 104 then closes to shut-off the supply of pressurized $CO_2$ gas to the water valve 64, causing the normally closed water valve 64 to cut-off the flow of water to the tank 76. Simultaneously, the gas within the signal line 66 is vented by the proximity switch 104 and exits the housing 102 to the atmosphere through the vent opening 105.

In operation, the first embodiment 10 of the beverage dispensing system can be used to dispense carbonated and noncarbonated mixed beverages, as well as any carbonated and noncarbonated unmixed beverages, in liquid form. To use the system, the water tank 52 is filled with water via the water tank refill check valve 62 and water chamber line 60. Once the water tank 52 has been filled to an appropriate level, the water tank valve 59 is manually switched to the gas open position such that the gas chamber 58 of the tank 52 and the high pressure gas supply line 50 are in open fluid communication with one another.

To initiate the carbonization process, the operator opens the shut-off valve 22 of the gas storage tank 20 so that high pressure $CO_2$ gas flows to the three gas pressure regulators 26, 28, and 30. After passing through the first pressure regulator 26, $CO_2$ gas flows into the carbonator tank 16, raising the pressure within the tank to approximately 90 psi to 110 psi. At approximately the same time, the high pressure $CO_2$ gas also flows through the second and third pressure regulators 28 and 30. After exiting the second pressure regulator 28, the gas is supplied to both to the carbonator tank filling system 40 and to the pumps 43 used in conjunction with the liquid reservoirs 51. The gas supplied to the filling system 40 is used, as needed, to refill the tank 76 with water. After passing through the third pressure regulator 30, the high pressure gas passes through the high pressure gas supply line 50, through the water tank valve 59, and into the gas chamber 58 of the water tank 52 to fill and pressurize the gas chamber 58.

As the $CO_2$ gas flows into the gas chamber 58, the water contained in the water chamber 56 is forced out of the tank 52 and flows through the water chamber line 60 to travel to both the carbonator tank water valve 64 and the water pressure regulator 72. The water that passes through the water pressure regulator 72 is routed into and through the flat water supply line 74 to be cooled by the cold plate 48 and, if desired, dispensed through the beverage dispenser valve 18.

Assuming the carbonator tank 16 to initially not contain water, the float member 88 contained therein is positioned near the bottom of the tank 76 and the carbonator tank filling system 40 is in the activated orientation shown in FIG. 2. When the filling system 40 is in this activated orientation, pneumatic pressure is provided to the water valve 64, keeping it in the open position so that water can flow into the tank 76. As the water continues to flow from the water tank 52 and fills all lines connected thereto, the pressure of the water begins to rise sharply. Eventually, the pressure of the water in the water chamber 56, and the lines in fluid communication therewith, reach a pressure equal to that of the high pressure $CO_2$ gas contained in the gas chamber 58. Accordingly, water enters the tank 76 at high pressure, typically at approximately 175 psi to 225 psi.

Since the carbonator tank 16 is relatively small when compared to the $CO_2$ container 20 and water tank 52, it normally fills quickly. Therefore, carbonated water is available soon after the carbonization process is initiated. As such, the operator can use the beverage dispensing valve 18, commonly referred to as a "bar gun," to dispense either flat water supplied by the flat water supply line 74 or carbonated water supplied by the carbonated water supply line 82. Similarly, syrup or other concentrated liquid, can be dispensed from the liquid reservoirs 51 with the vacuum pumps 43 in the manner described hereinbefore such that a mixed flat or carbonated drink can be post-mixed in a selected beverage container C.

Once the carbonator tank 16 is fill, the filling system 40 becomes arranged in the inactivated orientation shown in FIG. 3, thereby interrupting the supply of gas to the water valve 64. Not having the pressure signal needed to remain open, the water valve 64 closes, cutting the supply of water to the carbonator tank 16. As the water level is again lowered, the filling system 40 is again activated, restarting the process described in the foregoing. The system 40 therefore cycles in response to the volume of water contained within the carbonator tank 16. Typically, the cycle will occur repeatedly until either the gas or water supplies are depleted. At this time, either or both may be refilled, and the system reinitiated.

Figure 4:
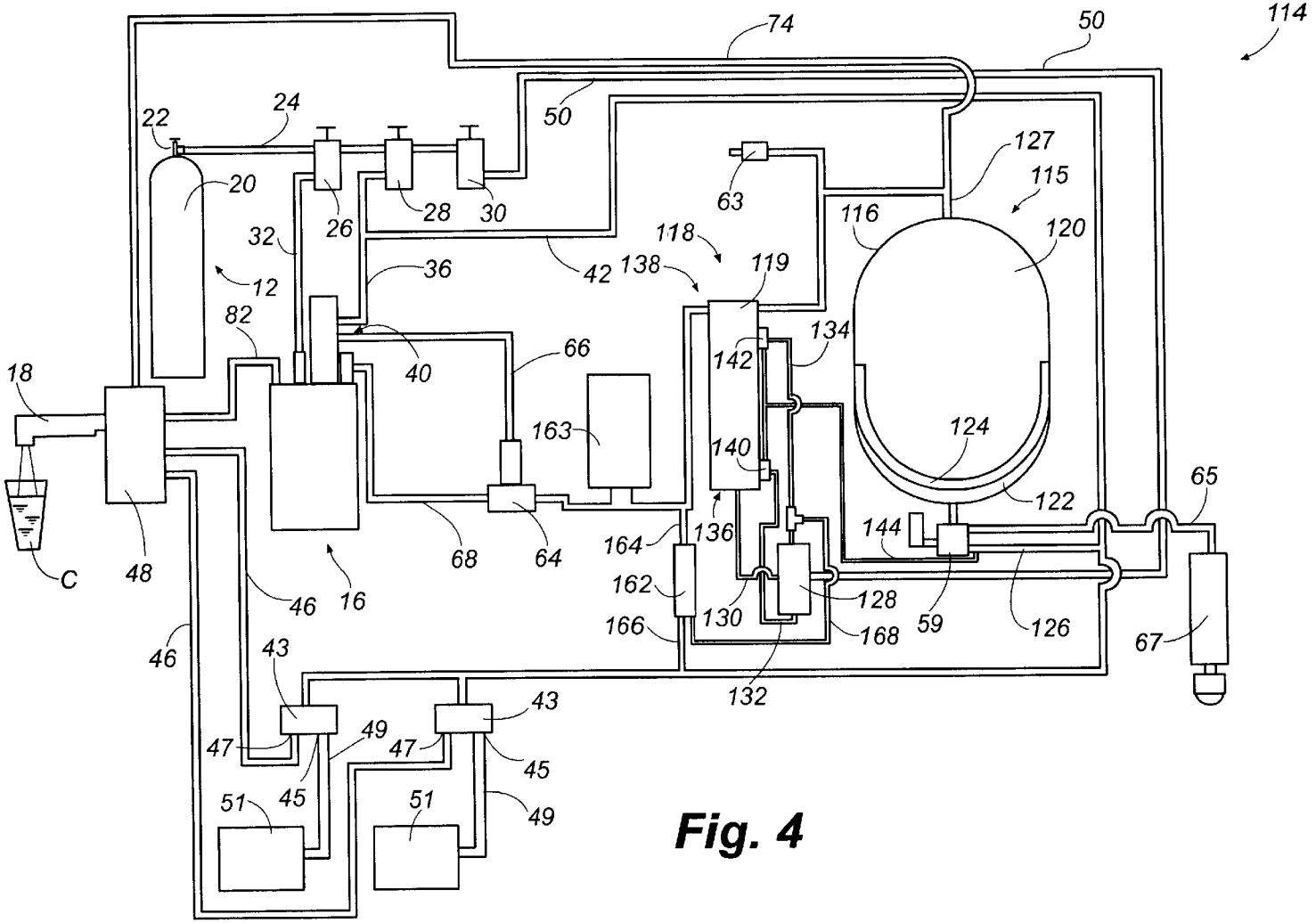
FIG. 4 is a schematic view of a second embodiment of a self-contained high pressure pneumatic beverage dispensing system.

FIG. 4 is a schematic view of a second embodiment 114 of a self-contained high pressure pneumatic beverage dispensing system. Since the second embodiment 114 is nearly identical in structure and function as that of the first except as to the water source and the pressure levels provided to the various components, the following discussion is focused on the water source 115 and the pressure levels associated therewith.

In this second embodiment 114, the high pressure water tank of the first embodiment is replaced with a low pressure water tank 116 and a high pressure water pump system 118 that includes a pneumatic water pump 119. The low pressure water tank 116 is similar in construction to the high pressure water tank and therefore has water and gas chambers 120 and 122 separated by a pliable diaphragm 124. Due to the presence of the pneumatic water pump 119, the water within the water tank 116 need not be at high pressure. Accordingly, instead of being supplied with $CO_2$ gas at approximately 175 psi to 225 psi, the water tank 116 is supplied with gas at pressures at approximately 25 psi to 60 psi. Therefore, the water tank 116 is supplied with gas from a low pressure gas supply line 126 that branches from the pump line 42 described in the discussion of the first embodiment 10. Since it will not be subjected to high pressure $CO_2$ gas, the low pressure water tank 116 can be constructed of a mild steel as opposed to a stainless steel which tends to be substantially more expensive. Similar to the water tank of the first embodiment, pressurized water can leave the water chamber 120 of the tank 116 through a water chamber line 127. In one direction, the pressurized water supplied by the water tank 116 flows to the pneumatic water pump 119 to fill it with water. In a second direction, the water flows through flat water line 74 to the cold plate 48.

In the second embodiment 114 of the dispensing system, the high pressure gas supply line 50 supplies gas at approximately 175 psi to 225 psi to a pneumatic water pump control valve 128. As shown in FIG. 4, in addition to the high pressure gas supply line 50, the control valve 128 is connected to a pump gas supply line 130, and first and second pneumatic signal lines 132 and 134. The pump gas supply line 130 connects in fluid communication to the pneumatic water pump 119 at its first end 136. The pneumatic signal lines 132 and 134 connect to first and second piston sensors 140 and 142 respectively. The first piston sensor 140 is mounted to the pump 119 adjacent its first end 136 and the second piston sensor 142 is mounted to the pump adjacent its second end 138. Each of the piston sensors 140 and 142 is connected to a sensor gas supply line 144 which is in fluid communication with the low pressure gas supply line 126.

Figure 5:
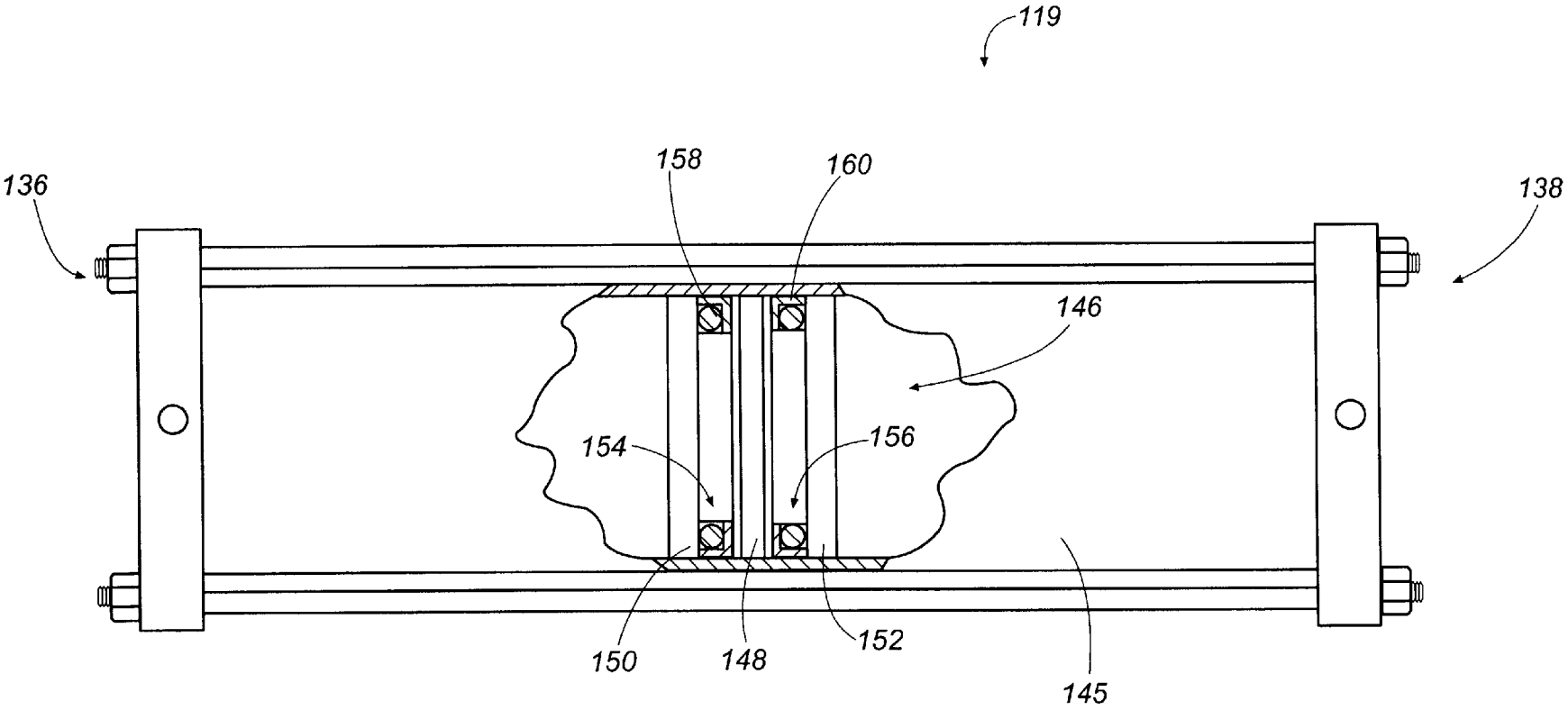
FIG. 5 is a partial cut-away view of the high pressure water pump used in the beverage dispensing system of FIG. 4.

As shown in FIG. 5, the pneumatic water pump 119 typically comprises a piston cylinder 145 and a rodless piston 146. The rodless piston 146 comprises a central magnet 148 that is positioned intermediate two piston end walls 150 and 152. Located between the magnet 148 and each of the end walls 150 and 152 are seals 154 and 156. Typically, these seals comprise an inner resilient O-ring 158 and an outer lip seal 160. Configured in this manner, the seals 154 and 156 prevent fluids from passing between the piston 146 and the piston cylinder 145, but permit sliding of the piston 146 along the cylinder 145.

In an initial filled state, with the piston 146 positioned adjacent the first end 136 of the pump 119, the first piston sensor 140 senses the proximity of the piston 146 due to its magnetic attraction thereto. When such a condition is sensed, the sensor 140 is activated and sends a pneumatic pressure signal to the control valve 128, causing the control valve 128 to open. While the control valve 128 is in the open position, high pressure gas flows through the control valve 128, along the pump gas supply line 130, and into the gas side of the pump 119. The high pressure gas displaces the piston 146 which, in turn, ejects the water contained in the water side of the pump 119, and eventually pressurizes the water to approximately 175 psi to 225 psi.

From the pump 119, the pressurized water flows to the carbonator tank 16 in similar manner as in the first embodiment 10. When nearly all of the water is driven out of the pump 119 with the piston 146, the second piston sensor 142 activates in similar manner to the first piston sensor 140, and sends a pneumatic pressure signal to the control valve 128 that causes the valve 128 to cut-off the supply of gas to the pump 119 and vent the piston cylinder 145 to the atmosphere so that the relatively low pressure water can again fill the pump 119. Once the pump 119 is completely filled, the first piston sensor 140 is activated, and the system cycles again.

Although the dispensing system of the second embodiment 114, as described herein, is believed to be complete and effective, the system can further include a pump reset switch 162 and/or an accumulator tank 163. As shown in FIG. 4, the reset switch 162 receives high pressure water from the pump 119 through water supply line 164. The reset switch 162 also receives low pressure $CO_2$ gas from the supply line 42 through gas supply line 166. Linking the reset switch 162 and the pump control valve 128 is a pneumatic signal line 168 which connects to the second signal line 134. So described, the pump reset switch 162 ensures that there is an adequate amount of carbonated water to meet the demand. For instance, if the piston 146 is positioned at some intermediate point along the length of its stroke and the carbonator tank 16 is filled, switching the water valve 64 off equilibrium can be achieved, dropping the pressure of the water, therefore indicating that the water pump 119 is not full. Upon sensing this water pressure drop, the reset switch 162 sends a pneumatic pressure signal to the control valve 128, causing the valve 128 to close and vent the gas pressure in the pump 119 so that the pump 119 can be refilled and a full piston stroke then executed.

Another optional component that ensures adequate supply of high pressure water is the accumulator tank 163. The accumulator tank 163 contains an internal diaphragm (not shown) which separates a lower chamber of the tank 163 from an upper chamber of the tank 163. In the upper chamber is a volume of nitrogen gas. In operation, the lower chamber fills with high pressure water supplied by the pump 119. As the accumulator tank 163 is filled, the nitrogen gas contained in the upper chamber is compressed. In this compressed state, the gas can force the water out of the accumulator tank 163 during situations in which carbonated water demand is high and the pump 119 is in the refill portion of its cycle.

Figure 6:
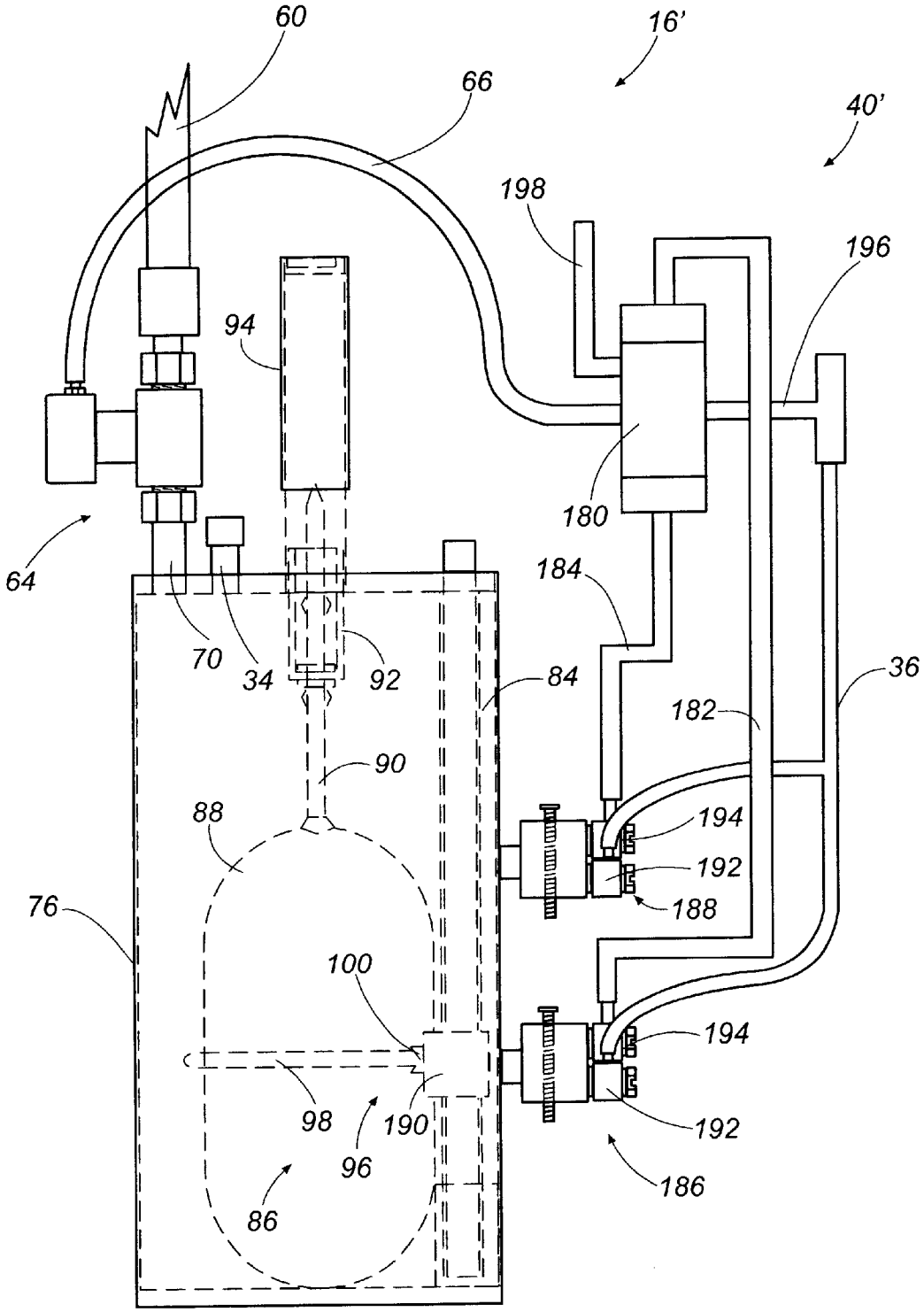
FIG. 6 is a side view of a second embodiment of a high pressure carbonator tank and filling system usable in the beverage dispensing system of FIG. 1, depicting an activated or fill orientation of the filling system.
Figure 7:
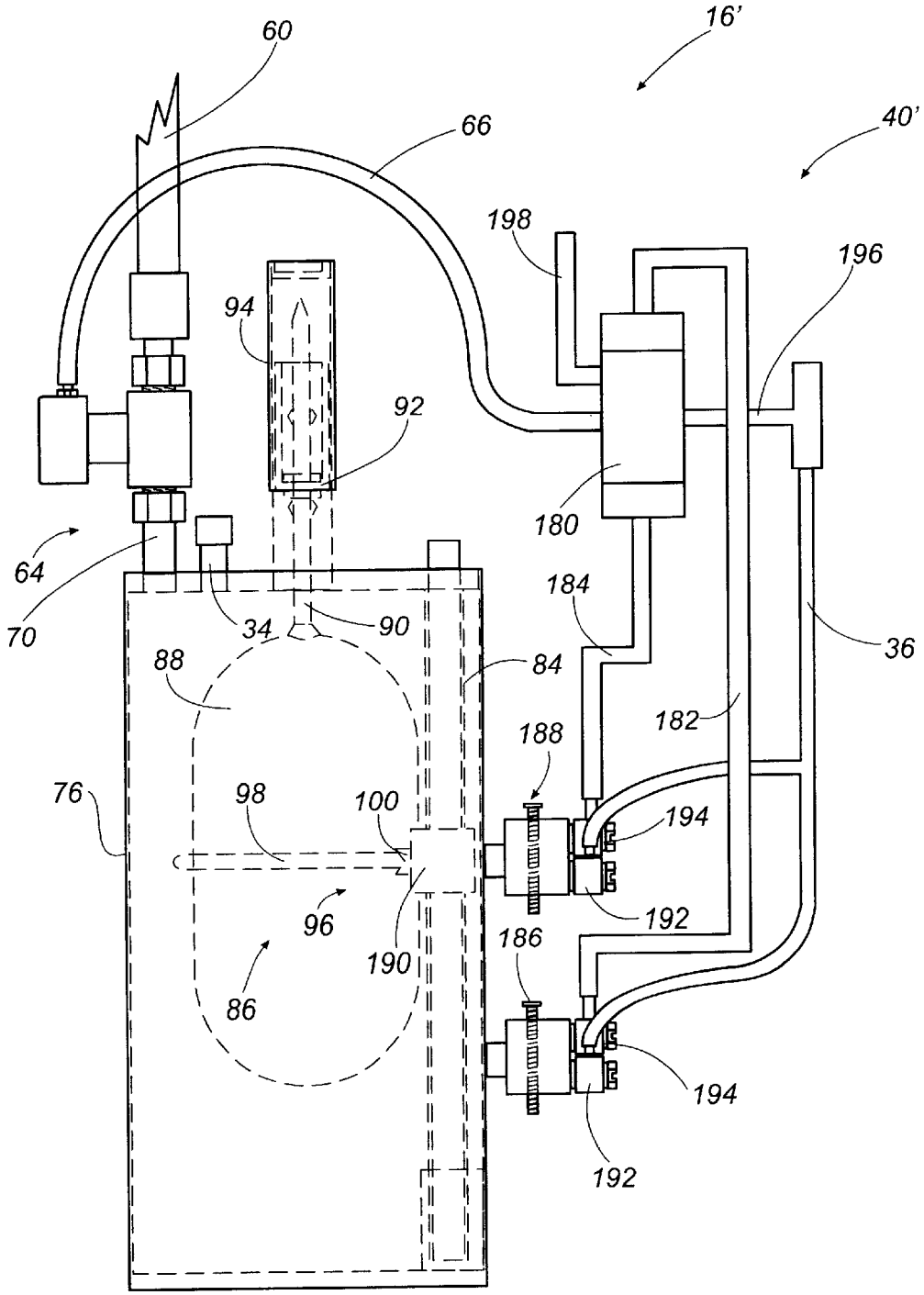
FIG. 7 is a side view of the carbonator tank and filling system of FIG. 6, depicting an inactivated or full orientation of the filling system.

FIGS. 6 and 7 illustrate a second embodiment of a carbonator tank 16' and a carbonator tank filling system 40' that can be used in either of the dispensing systems described in the foregoing. As is evident from FIGS. 6 and 7, the carbonator tank 16' and filling system 40' of the second embodiment utilizes several of the same components used with the carbonator tank 16' and filling system 40' of the first embodiment. For this reason, the following discussion focuses on the components that are different from those described in the foregoing and the alternative functioning that results therefrom. Included in the filling system 40' is a control valve 180 that is used to send pneumatic signals to the carbonator tank water valve 64 by way of the water valve signal line 66. This control valve 180 typically comprises a normally closed, three-way double pivot valve of conventional design. The control valve 180 is connected to first and second signal lines 182 and 184 that place the control valve 180 in fluid communication with first and second proximity switches 186 and 188, respectively. These proximity switches 186, 188 typically comprise normally closed, three-way magnetic proximity switches that are located at strategic positions with respect to the tank 76 such that the fill condition of the tank 76 can be sensed therewith. In particular, the first proximity switch 186 is positioned such that it is directly adjacent a magnetic member 190 that, by way of example, is mounted to the slide member 100 of the water level indicator mechanism 86 when the tank 76 is empty, as shown in FIG. 6. In like manner, the second proximity switch 188 is positioned so as to be directly adjacent the magnetic member 190 when the tank 76 is filled with water, as shown in FIG. 7. Normally, the magnetic member 190 is formed as a magnetic collar that is disposed around the carbonated water supply tube 84 located within the tank 76.

Connected to each of the proximity switches 186, 188 is the filling system supply line 36 which provides each of the proximity switches 186, 188 with a $CO_2$ gas. In particular, the filling system supply line 36 connects to a gas inlet 192 of each proxmity switch 186, 188. Similarly, the first and second signal lines 182 and 184 connect to the first and second proximity switches 186 and 188, respectively, through gas outlets 194. Branching off from the filling system supply line 36 is a control valve supply line 196 which provides the control valve 180 with a $CO_2$ gas from the source 12 of $CO_2$ gas. Further connected to the control valve 180 is a vent line 198 which can either be open to the atmosphere or which, alternatively, can be connected to the vent line 65 which leads to the diffuser 67.

In operation, the carbonator tank 16' and filling system 40' function in similar manner to their counterparts of the first embodiment. When the tank 76 is not full, as indicated in FIG. 6, the first proximity switch 186 senses the proximity of the magnetic member 190 to keep the proximity switch 186 in an open position. While in this open position, $CO_2$ gas flows from the filling system supply line 36, through the proximity switch 186, and into the first signal line 182 to provide this gas to the control valve 180. With this pneumatic signal being received by the control valve 180, the control valve 180 in turn sends a signal via the pneumatic signal line 66 to the water valve 64 to cause the water valve 64 to also remain in an open position such that high pressure water can flow into the tank 76. As the tank 76 fills with water, the float member 88 rises within the tank 76 until the first proximity switch 186 can no longer sense the proximity of the magnetic member 190. At such time, the first proximity switch 186 returns to its normally closed position and vents the gas contained in the signal line 182 to the atmosphere. Despite the closing of the first proximity switch 186, the control valve 180 continues to send a pneumatic signal to the water valve 64 to keep it open in that a new signal must be sent to the control valve 180 to cause it to toggle off.

As the float member 88 continues to rise within the tank 76, the magnetic member 190 eventually becomes positioned near the second proximity switch 188. Once the magnetic member 190 is positioned adjacent the proximity switch 188 as indicated in FIG. 7, the proximity switch 188 opens to send a pneumatic signal along the second signal line 184 to the control valve 180. This signal causes the control valve 180 to toggle shut and interrupt the signal sent to the water valve 64 to cause it to close, thereby interrupting the flow of high pressure water to the tank 76. As in the first embodiment, the float member 88 will travel downwardly within the tank 76 as carbonated water is removed from the tank 76. Once the float member 88 is positioned such that the magnetic member 190 once again is positioned adjacent the first proximity switch 186, the fill cycle begins again and proceeds in the manner described in the foregoing.

Figure 8:
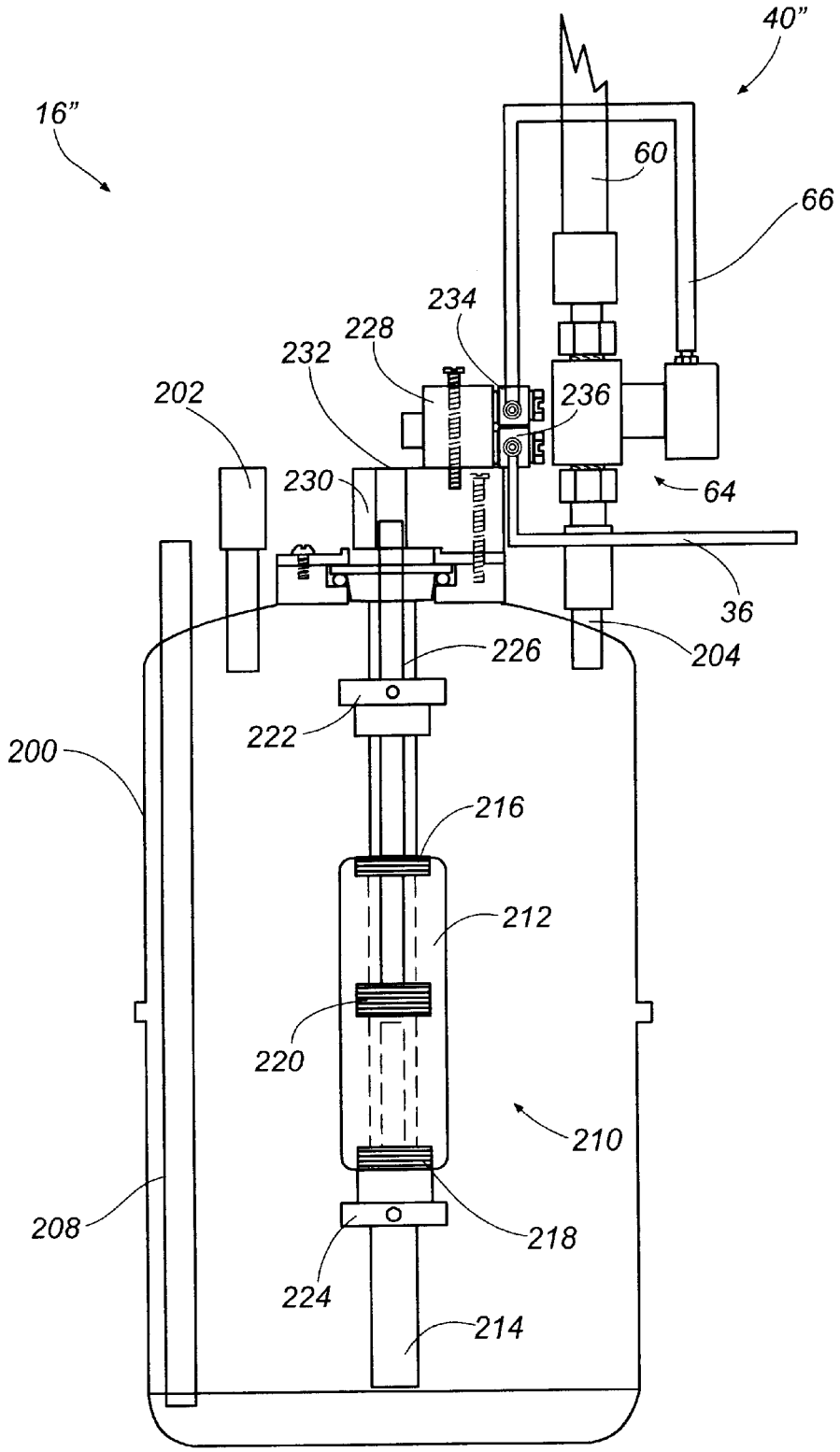
FIG. 8 is a side view of a third embodiment of a high pressure carbonator tank and filling system usable in the beverage dispensing system of FIG. 1, depicting an activated or fill orientation of the filling system.
Figure 9:
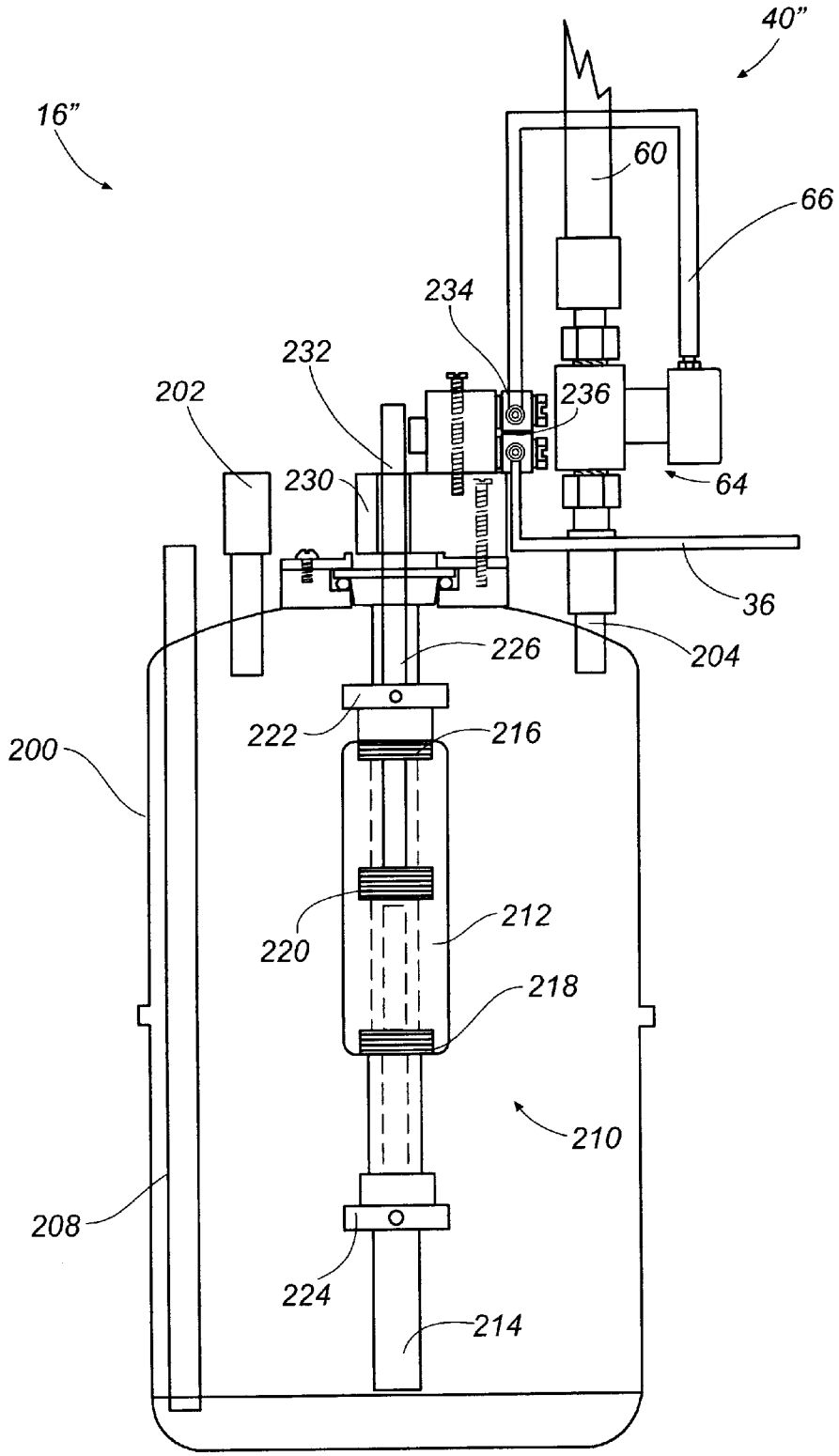
FIG. 9 is a side view of the carbonator tank and filling system of FIG. 8, depicting an inactivated or full orientation of the filling system.

FIGS. 8 and 9 illustrate a third embodiment of a carbonator tank 16" and a carbonator tank filling system 40" usable in either of the dispensing systems described hereinbefore. By way of example, this carbonator tank 16" can comprise a high capacity carbonator tank available from McCann under Model No. 4300-1000. Like the carbonator tank of the first two embodiments, the carbonator tank 16" illustrated in FIGS. 8 and 9 comprises a generally cylindrical tank 200. Mounted to the top of the tank 200 is a gas inlet 202 and a water inlet 204. Normally, each of these inlets 202, 204 includes a check valve (not shown) which prevents reverse flow of water and gas therethrough. Inside the tank 200 is a carbonated water supply tube 208 which extends out from the tank 200 to connect to the carbonated water supply line 82 (FIG. 1).

Like the carbonator tanks of the first two embodiments, the carbonator tank 16" of the third embodiment includes a water level indicator mechanism 210. This mechanism 210 includes a float member 212 that is disposed about a float travel tube 214. Provided at the top of the float member 212 is a first magnet 216. Provided at the bottom of the float member 212 is a second magnet 218. Typically, each of these magnets 216, 218 is arranged as a ring magnet that wraps around the float travel tube 214. Positioned within the float member 212 is a third magnet 220, the purpose for which is described hereinafter. Fixedly positioned along the float travel tube 214 are first and second magnet collars 222 and 224. Normally, these magnetic collars 222, 224 are constructed of a magnetic stainless steel material. As indicated in FIGS. 8 and 9, the first and second collars 222 and 224 limit the axial travel of the float member 212 along the float travel tube 214. Disposed within the float travel tube 214 is a magnetic rod 226 which, as described hereinafter, is magnetically coupled to the third magnetic 220 that is disposed within the float member 212.

The water level within the tank 200 is monitored and controlled by the filling system 40" which includes a proximity switch 228 that normally is mounted to the top of the tank 200 with a mounting bracket 230. This mounting bracket can include an opening 232 which, as illustrated in FIGS. 8 and 9, permits the magnetic rod 226 disposed within the float travel tube 213 to extend outwardly from the carbonator tank 16" as the water level within the tank 200 rises. The proximity switch 228 typically comprises a normally open, three-way magnetic proximity switch that can sense the proximity of the magnetic rod 226. The proximity switch 228 is fluidly connected to the carbonator tank water valve 64 with the water valve signal line 66 that is connected to a gas outlet 234 formed on the proximity switch 228. In addition, the proximity switch 228 is fluidly connected to the source 12 of gas via the filling system supply line 36 which is connected to a gas inlet 236 of the proximity switch 228.

When the tank 200 is empty as shown in FIG. 8, the proximity switch 228 does not sense presence of the magnetic rod 226 and therefore remains open such that a pneumatic signal is provided to the water valve 64 to keep it in the open position and allow high pressure water to enter the tank 200. As the water level in the tank 200 rises, an upward force is exerted upon the float member 212 because of its buoyancy. However, due to the attraction between the second magnet 218 positioned at the bottom of the float member 212 and the second magnetic collar 224 disposed on the float travel tube 214, the float member 212, at least initially, remains in the orientation indicated in FIG. 8. Once the water level rises further, however, the upward force on the float member 212 eventually exceeds the force of attraction between the second magnet 218 and the second magnetic collar 224 such that the float member 212 will toggle upwardly into the position shown in FIG. 9 in which the first magnet 216 is positioned directly adjacent the first magnetic collar 222 disposed on the float travel tube 214 above the float member 212.

Despite being separated by the walls of the float travel tube 214, the magnetic rod 216 that is disposed within the float travel tube 214 travels upwardly along with the third magnet 220 disposed in the float member 212 because of the magnetic coupling therebetween. As shown in FIG. 9, this upward movement of the magnetic rod 226 places the rod 226 in close proximity to the proximity switch 228. This proximity of the rod 226 causes the proximity switch 228 to close to interrupt the pneumatic signal to the water valve 64 which, in turn, causes the normally closed water valve 64 to interrupt the flow of high pressure water to the tank 200. Simultaneously, the proximity switch 228 vents the gas contained within the signal line 66 to relieve the pressure contained therein. Operating in this manner, the filling system 40" operates with a time delay which allows the tank 200 to fill completely.

Figure 10:
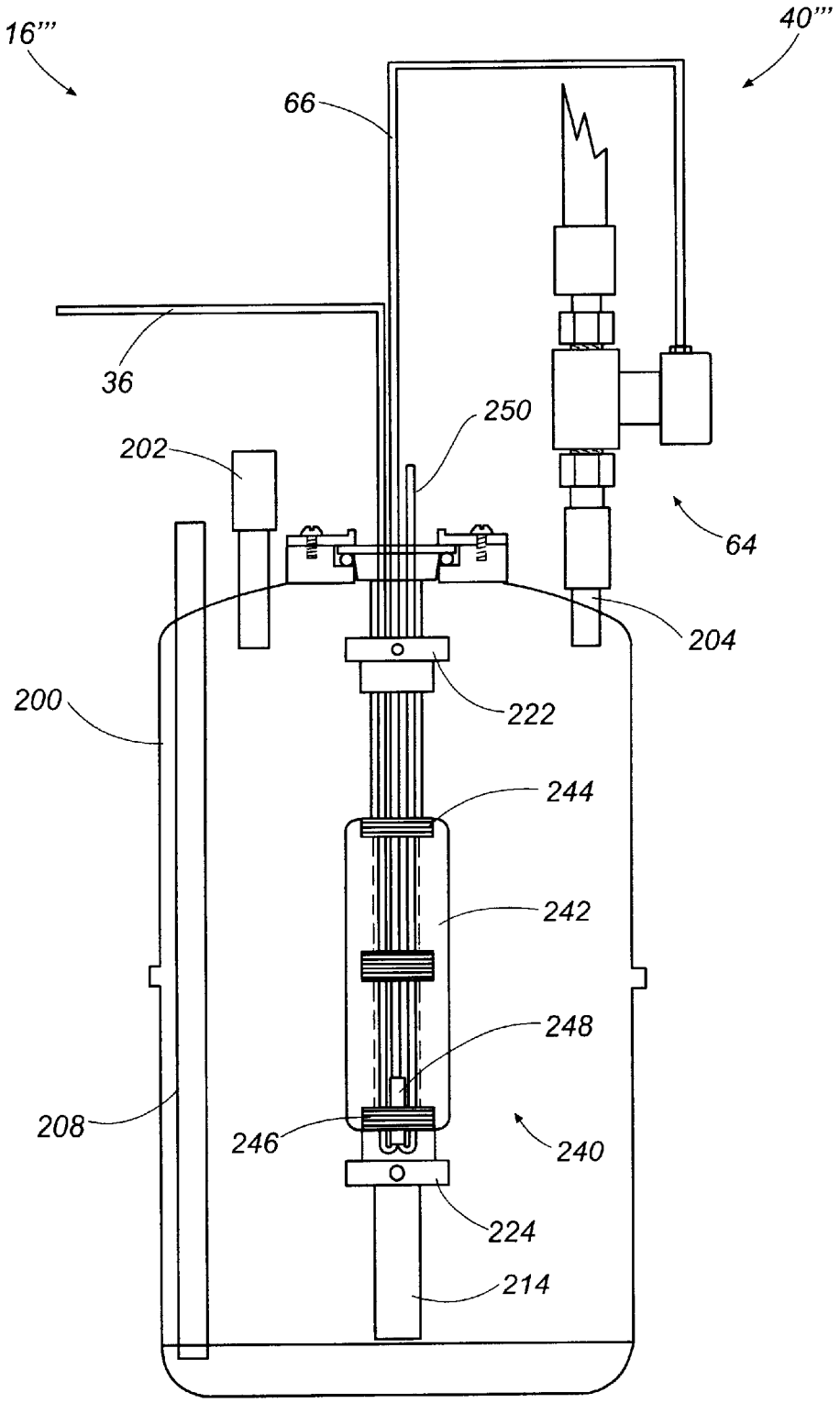
FIG. 10 is a side view of a fourth embodiment of a high pressure carbonator tank and filling system usable in the beverage dispensing system of FIG. 1, depicting an activated or fill orientation of the filling system.
Figure 11:
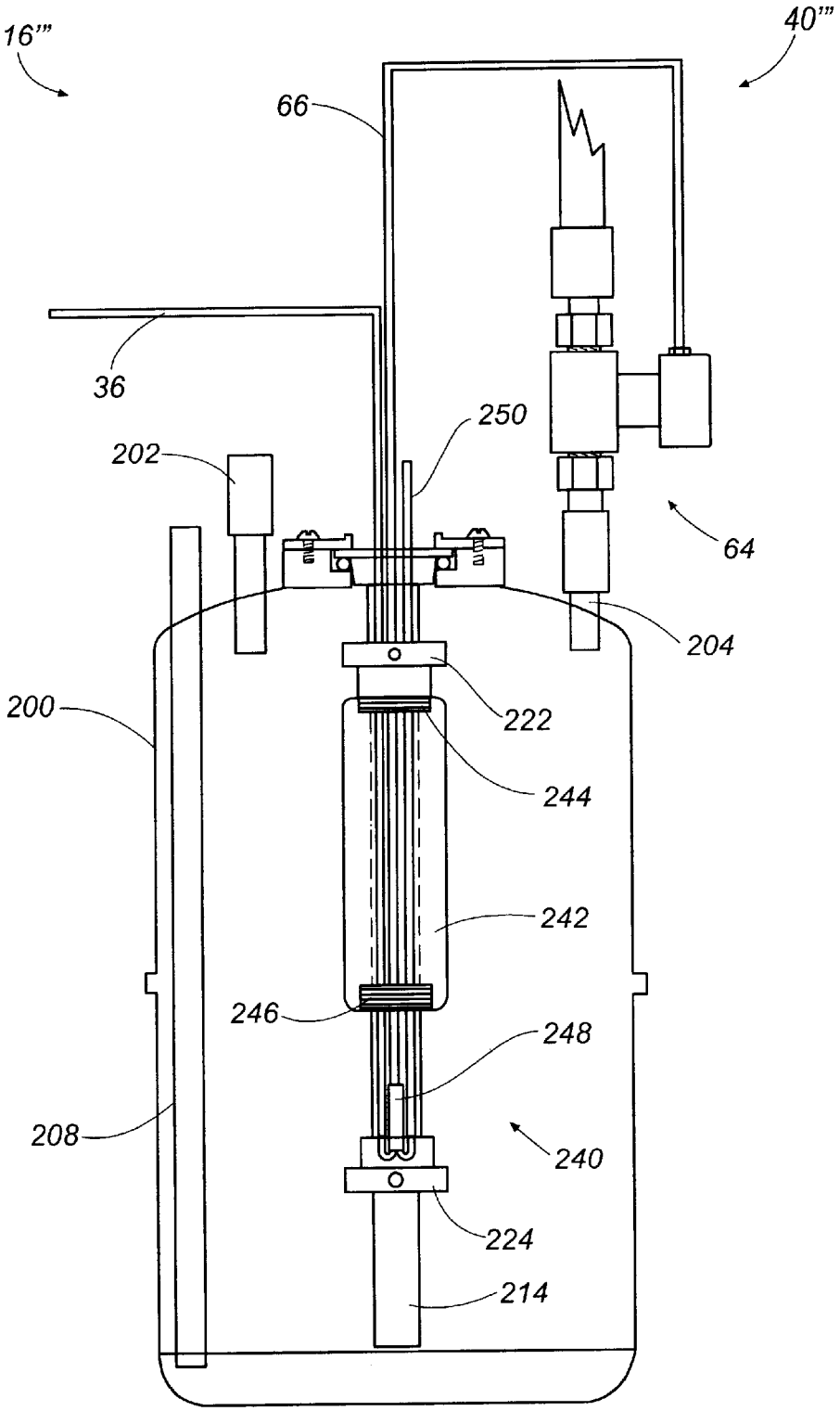
FIG. 11 is a side view of the carbonator tank and filling system of FIG. 10, depicting an inactivated or full orientation of the filling system.

FIGS. 10 and 11 show a fourth embodiment of a carbonator tank 16''' and a carbonator tank filling system 40''' usable with either of the dispensing systems described in the foregoing. As is evident from these figures, the carbonator tank 16''' is similar in construction to the carbonator tank of the third embodiment shown in FIGS. 8 and 9. Accordingly, the carbonator tank 16''' can comprise a high capacity carbonator tank such as that available from McCann under Model No. 4300-1000. Due to the similarities of the carbonator tank 16''' shown in FIGS. 10 and 11 and the carbonator tank shown in FIGS. 8 and 9, the following discussion focuses upon the structural and functional differences between these two embodiments.

Like the carbonator tank of the third embodiment, the carbonator tank 16''' includes a water level indicator mechanism 240. This mechanism 240 includes a float member 242 which has first and second magnets 244 and 246 that are positioned at the top and bottom of the float member 242, respectively. The float member 242 is disposed around a float travel tube 214 which includes first and second magnetic collars 222 and 224 that are fixedly disposed thereon.

Forming part of the filling system 40''' is a proximity switch 248 that is disposed within the float travel tube 214. Typically, this proximity switch 248 comprises a normally closed, three-way magnetic proximity switch The proximity switch 248 can sense the presence of the second magnet 246 when the magnet 246 is disposed adjacent thereto as indicated in FIG. 10. The proximity switch 248 is connected to the filling system supply line 36, the water valve signal line 66, and also a vent line 250. Each of these lines extends into the carbonator tank 16''' through the float travel tube 214. In particular, the filling system supply line 36 extends into the tube 214 to connect to the proximity switch 248 to supply it with $CO_2$ gas. When the carbonator tank 16''' is empty as shown in FIG. 10, the normally closed proximity switch 248 remains open due to the presence of the second magnet 246 to pass the $CO_2$ gas along the signal line 66 to the water valve 64 to keep the water valve 64 in an open position such that high pressure water travels into the tank 200. As the tank 200 fills with water, however, the float member 242 toggles to the upward position shown in FIG. 11, in similar manner to the float member of the embodiment shown in FIGS. 8 and 9, to close the proximity switch 248, interrupt the signal passed to the water valve 64, and vent the gas contained within the signal line 66 to the atmosphere via the vent line 250.

Through the present disclosure, various dispensing systems, carbonator tanks, and carbonator tank filling systems have been described. Although exemplary embodiments have been provided in detail in the foregoing description and drawings, it will be understood by those skilled in the art that variations and modifications such as alternative combinations of components of those shown and described can be made without departing from the spirit and scope of the invention as set forth in the claims and such variations and modifications are intended to be part of this disclosure. For instance, although the second embodiment of the dispensing system is described as comprising a separate water tank and water pump, it will be understood by persons having ordinary skill in the art that these two components could essentially be combined into a single component such as a high volume, high pressure water pump. In such an arrangement, the pump would function similarly as the pump described in the second embodiment, however, would only complete one stroke instead of cycling between dispensing and refilling strokes. Because of this fact, the pump control valve, piston sensors, and associated lines would be unnecessary in such an embodiment.

What is claimed is:

1. A carbonator tank filling system, comprising:

a water valve adapted to connect in fluid communication with a carbonator tank and to a source of pressurized water, said water valve having an open position in which water from the source of pressurized water can flow through said water valve and into the carbonator tank and having a closed position in which water from the source of pressurized water cannot flow through said water valve into the carbonator tank; and at least one proximity switch adapted to operably connect in fluid communication to said water valve and a source of pressurized gas, said at least one proximity switch having an open position in which gas from the source of pressurized gas can flow through said at least one proximity switch and having a closed position in which gas from the source of gas cannot flow through said at least one proximity switch, said at least one proximity switch being configured so as to detect a fill condition of the carbonator tank so that said at least one proximity switch can send a pneumatic signal to said water valve to cause said water valve to open or shut depending upon the detected fill condition.

2. The filling system of claim 1, wherein said proximity switch is a magnetic proximity switch and said filling system further comprises a pivotable lever arm including a magnetic member whose proximity to said proximity switch can be detected by said proximity switch.

3. The filling system of claim 2, wherein said pivotable lever arm is adapted to pivot to a first position and to a second position in response to the fill condition of the carbonator tank.

4. The filling system of claim 3, wherein said pivotable lever arm includes a magnet that is adapted to be positioned directly adjacent a magnetic member of the carbonator tank when the carbonator tank is substantially full.

5. The filling system of claim 4, wherein said proximity switch is normally closed and wherein said magnetic member of said pivotable lever arm is not positioned adjacent to said proximity switch when the magnetic member of the carbonator tank is positioned directly adjacent said magnet of said pivotable lever arm, thereby interrupting the pneumatic signal sent by said proximity switch to said water valve.

6. The filling system of claim 5, wherein said water valve is normally closed such that when the pneumatic signal sent by said proximity switch to said water valve is interrupted, said water valve closes to interrupt the flow of water into the carbonator tank.

7. The filling system of claim 1, wherein said filling system comprises first and second proximity switches each in fluid communication with the source of pressurized gas, said proximity switches adapted to detect a substantially empty condition of the carbonator tank and a substantially full condition of the carbonator tank, respectively, and send a pneumatic signal identifying this condition.

8. The filling system of claim 7, further comprising a control valve in fluid communication with each of said first and second proximity switches so as to receive the pneumatic signals sent by said proximity switches, said control valve further being in fluid communication with said water valve so as to be able to send pneumatic signals thereto.

9. The filling system of claim 8, wherein each of said proximity switches is a magnetic proximity switch that is adapted to detect the proximity of a magnetic member of the carbonator tank, wherein detection of the magnetic member by said first proximity switch indicates the substantially empty condition and detection of the magnetic member by said second proximity switch indicated the substantially full condition.

10. The filling system of claim 9, wherein each of said proximity switches is normally closed such that when proximity of the magnetic member of the carbonator tank is detected, the pneumatic signal sent by said proximity switch to said control valve is interrupted.

11. The filling system of claim 10, wherein said control valve sends and interrupts pneumatic signals to said water valve to cause it to remain open or close, respectively, in response to the pneumatic signals received by said proximity switches.

12. The filling system of claim 11, wherein said water valve is normally closed and when said first proximity switch sends a pneumatic signal to said control valve, said control valve sends a pneumatic signal to said water valve to cause it to stay open.

13. The filling system of claim 1, wherein said proximity switch is a magnetic proximity switch that is adapted to detect the proximity of a magnetic member of the carbonator tank.

14. The filling system of claim 13, wherein said proximity switch is normally open and proximity of the magnetic member of the carbonator tank is detected when the tank is substantially full.

15. The filling system of claim 14, wherein said water valve is normally closed such that when the proximity of the magnetic member of the carbonator tank is detected, said proximity switch closes to interrupt the pneumatic signal sent to said water valve to cause said water valve to close.

16. The filling system of claim 15, wherein said proximity switch is adapted to mount to the top of the carbonator tank to detect the magnetic member of the carbonator tank when it extends upwardly out of the tank.

17. The filling system of claim 1, wherein said proximity switch is adapted to mount within the carbonator tank.

18. The filling system of claim 17, wherein said proximity switch is a magnetic proximity switch that is adapted to detect the proximity of a magnetic member of the carbonator tank.

19. The filling system of claim 18, wherein said proximity switch is normally closed and said water valve is normally closed.

20. The filling system of claim 19, wherein said proximity switch is adapted to detect the proximity of the magnetic member of the carbonator tank when the tank is substantially empty.

21. A self-contained high pressure pneumatic beverage dispensing system, comprising:

a carbonator tank for facilitating absorption of $CO_2$ gas in water to produce carbonated water;

a water valve connected in fluid communication with said carbonator tank and adapted to connect in fluid communication with a source of pressurized water, said water valve having an open position in which water from the source of pressurized water can flow through said water valve and into said carbonator tank and having a closed position in which water from the source of pressurized water cannot flow through said water valve into said carbonator tank; and at least one proximity switch operably connected in fluid communication with said water valve and adapted to connect in fluid communication with a source of pressurized gas, said at least one proximity switch having an open position in which gas from the source of pressurized gas can flow through said at least one proximity switch and having a closed position in which gas from the source of gas cannot flow through said at least one proximity switch, said at least one proximity switch being configured so as to detect a fill condition of said carbonator tank so that said at least one proximity switch can send a pneumatic signal to said water valve to cause said water valve to open or shut depending upon the detected fill condition.

22. The dispensing system of claim 21, wherein said carbonator tank comprises a water level indicator mechanism including a float member that causes a magnetic member of said dispensing system to change position in response to a the fill condition of said carbonator tank.

23. The dispensing system of claim 22, wherein said proximity switch is a magnetic proximity switch which can detect the proximity of said magnetic member.

24. The dispensing system of claim 23, wherein said water valve is normally closed and the pneumatic signal sent to said water valve is interrupted when said carbonator tank is substantially full.

25. The dispensing system of claim 21, wherein said proximity switch is a magnetic proximity switch and said filling system further comprises a pivotable lever arm including a magnetic member whose proximity to said proximity switch can be detected by said proximity switch.

26. The dispensing system of claim 25, wherein said pivotable lever arm is adapted to pivot to a first position and to a second position in response to the fill condition of said carbonator tank.

27. The dispensing system of claim 26, wherein said pivotable lever arm includes a magnet that is adapted to be positioned directly adjacent a magnetic member of said carbonator tank when said carbonator tank is substantially full.

28. The dispensing system of claim 27, wherein said proximity switch is normally closed and wherein said magnetic member of said pivotable lever arm is not positioned adjacent to said proximity switch when said magnetic member of said carbonator tank is positioned directly adjacent said magnet of said pivotable lever arm, thereby interrupting the pneumatic signal sent by said proximity switch to said water valve.

29. The dispensing system of claim 28, wherein said water valve is normally closed such that when the pneumatic signal sent by said proximity switch to said water valve is interrupted, said water valve closes to interrupt the flow of water into said carbonator tank.

30. The dispensing system of claim 21, comprising first and second proximity switches each in fluid communication with the source of pressurized gas, said proximity switches adapted to detect a substantially empty condition of said carbonator tank and a substantially full condition of said carbonator tank, respectively, and send a pneumatic signal identifying this condition.

31. The dispensing system of claim 30, further comprising a control valve in fluid communication with each of said first and second proximity switches so as to receive the pneumatic signals sent by said proximity switches, said control valve further being in fluid communication with said water valve so as to be able to send pneumatic signals thereto.

32. The dispensing system of claim 31, wherein each of said proximity switches is a magnetic proximity switch that is adapted to detect the proximity of a magnetic member of said carbonator tank, wherein detection of said magnetic member by said first proximity switch indicates the substantially empty condition and detection of said magnetic member by said second proximity switch indicated the substantially full condition.

33. The dispensing system of claim 32, wherein each of said proximity switches is normally closed such that when proximity of the magnetic member of said carbonator tank is detected, the pneumatic signal sent by said proximity switch to said control valve is interrupted.

34. The dispensing system of claim 33, wherein said control valve sends and interrupts pneumatic signals to said water valve to cause it to remain open or close, respectively, in response to the pneumatic signals received by said proximity switches.

35. The dispensing system of claim 34, wherein said water valve is normally closed and when said first proximity switch sends a pneumatic signal to said control valve, said control valve sends a pneumatic signal to said water valve to cause it to stay open.

36. The dispensing system of claim 21, wherein said proximity switch is a magnetic proximity switch that is adapted to detect the proximity of a magnetic member of said carbonator tank.

37. The dispensing system of claim 36, wherein said proximity switch is normally open and proximity of said magnetic member of said carbonator tank is detected when said tank is substantially full.

38. The dispensing system of claim 37, wherein said water valve is normally closed such that when the proximity of said magnetic member of said carbonator tank is detected, said proximity switch closes to interrupt the pneumatic signal sent to said water valve to cause said water valve to close.

39. The dispensing system of claim 38, wherein said proximity switch is mounted to the top of said carbonator tank to detect said magnetic member when it extends upwardly out of said tank.

40. The dispensing system of claim 21, wherein said proximity switch is mounted within said carbonator tank.

41. The dispensing system of claim 40, wherein said proximity switch is a magnetic proximity switch that is adapted to detect the proximity of a magnetic member of said carbonator tank.

42. The dispensing system of claim 41, wherein said proximity switch is normally closed and said water valve is normally closed.

43. The dispensing system of claim 42, wherein said proximity switch is adapted to detect the proximity of said magnetic member of said carbonator tank when said tank is substantially empty.

44. A method for filling a carbonator tank, comprising:

measuring the fill condition of the carbonator tank;

sensing the measured fill condition with a pneumatic proximity switch in fluid communication with a pneumatic water valve; and sending a pneumatic signal from the proximity switch to the water valve in response to the sensed fill condition to open or close the water valve to fill the carbonator tank with water as needed.

* * * * *